United States Patent [19]

Lin

[11] Patent Number: 4,798,411

[45] Date of Patent: Jan. 17, 1989

[54] COLLAPSIBLE COMBINED TABLE AND CHAIR ASSEMBLY

[76] Inventor: Pao C. Lin, No. 35, Lane 221, Sung-Chiang St., San-Min District, Kaohsiung City, Taiwan

[21] Appl. No.: 71,219

[22] Filed: Jul. 8, 1987

[51] Int. Cl.[4] ..... A47B 83/02

[52] U.S. Cl. ..... 297/170; 297/174

[58] Field of Search ..... 297/170, 135, 171, 172, 297/174, 140, 144, 143

[56] References Cited

U.S. PATENT DOCUMENTS

| | | | |
|---|---|---|---|
| 3,244,450 | 4/1966 | Boutin | 297/172 X |
| 3,606,846 | 9/1971 | Andrews et al. | 297/170 X |

FOREIGN PATENT DOCUMENTS

| | | | |
|---|---|---|---|
| 106880 | 3/1967 | Denmark | 297/171 |
| 1199450 | 8/1965 | Fed. Rep. of Germany | 297/174 |
| 982637 | 6/1951 | France | 297/170 |
| 1025052 | 4/1953 | France | 297/172 |
| 1208998 | 2/1960 | France | 297/170 |
| 504893 | 12/1954 | Italy | 297/170 |
| 581031 | 8/1958 | Italy | 297/174 |
| 670180 | 10/1964 | Italy | 297/174 |
| 69502 | 4/1943 | Norway | 297/172 |

*Primary Examiner*—Kenneth J. Dorner
*Assistant Examiner*—Laurie K. Cranmer
*Attorney, Agent, or Firm*—Cushman, Darby & Cushman

[57] ABSTRACT

A collapsible combined table and chair assembly comprises a first telescopic strut connected with a rear U-shaped leg member and a second strut hinged to the intermediate part of the first strut and connected with a front U-shaped leg member. A foldable table unit is mounted at the upper end portion of the first strut and a chair unit is mounted on an upstanding support extending from the first strut near the rear leg member.

14 Claims, 5 Drawing Sheets

COLLAPSIBLE COMBINED TABLE AND CHAIR ASSEMBLY

BACKGROUND OF THE INVENTION

1. FIELD OF THE INVENTION

This invention relates to an improvement for a collapsible combined table and chair assembly.

2. DESCRIPTION OF THE PRIOR ART

The present invention relates to provide a collapsible combined table and chair assembly which can be collapsed to a size more compact than conventional collpasible combined table and chair assemblies.

SUMMARY OF THE INVENTION

An object of the invention is to provide a collapsible combined table and chair assembly with a construction stronger and more stable than conventional collapsible combined table and chair assemblies which are used commonly by children for reading and writing.

The present invention provides a collapsible combined table and chair assembly which includes: a front U-shaped support having a front transverse rod and two front legs; a rear U-shaped support having a rear transverse rod and two rear legs; a first telescopic strut extending upwardly and forwardly and having a lower end portion connected fixedly to the rear transverse rod, an upper end portion, and an upstanding support tube extending from the first telescopic strut between the upper and lower end portions; a second strut having a lower end fixed to the front transverse rod, and an upper end hinged to the first telescopic strut at a location higher than that at which the upstanding support is located; a locking structure for preventing the upper end of the second strut from pivoting relative to the first telescopic strut; a table unit connected hingedly to the upper end portion of the first strut; and a chair unit connected hingedly to the upstanding support.

In one aspect of the invention, the first telescopic strut includes an inclined elongated tube having a lower end portion fixed to the rear transverse rod and extending from the rear transverse rod upwardly and forwardly, an upper section connected telescopically to an upper end portion of the elongated tube and having a forked end member for extending forwardly and horizontally to support the table unit, means for securing releaseably the upper section to the elongated tube, a lower section connected telescopically to the lower end portion of the elongated tube and extending downwardly and rearwardly, and means for securing releaseably the lower section to the elongated tube.

In further aspect of the invention, the table unit has a table panel to be laid on the forked end member, and brace bars underlying and attached to the bottom side of the table panel and extending in a direction from the rear side to the frot side of the table panel, the brace bars having front ends hinged to the ends of the forked end member so as to permit the table panel to turn forwardly and then downwardly when the assembly is collapsed.

In a further aspect of the invention, the upstanding support includes a support tube extending from the first strut, a seat supporting member mounted telescopically on the support tube and having an enlarged top portion which has a top bearing face, wherein the chair unit includes a chair panel to be laid on the top bearing face, brace bars underlying and attached to the bottom side of the chair panel, the brace bars having front end hinged to a front end portion of the enlarged portion.

In still further aspect of the invention, the first telescopic strut includes a plate bracket of U-shaped cross-section which has a base plate portion affixed to the first telescopic strut, two parallel flanks at two opposite sides of the base plate portion to confine a space for receiving and to serve as supports for hinging the second strut at a first pivot axis, wherein the locking means includes a hook member which has one end hinged to the flanks to pivot about a second pivot axis lower than the first pivot axis and an opposite end with a hooking flange and an engaging protrusion, and a loop member attached to a lower side of the second strut for engaging with the hook member, the second strut further having an engaging hole therein to engage with the engaging protrusion.

The present exemplary preferred embodiment will be described in detail with reference to the following drawings, in which:

DETAILED DESCRIPTION OF THE PREFERRED EMBODIMENT

Figure 1:
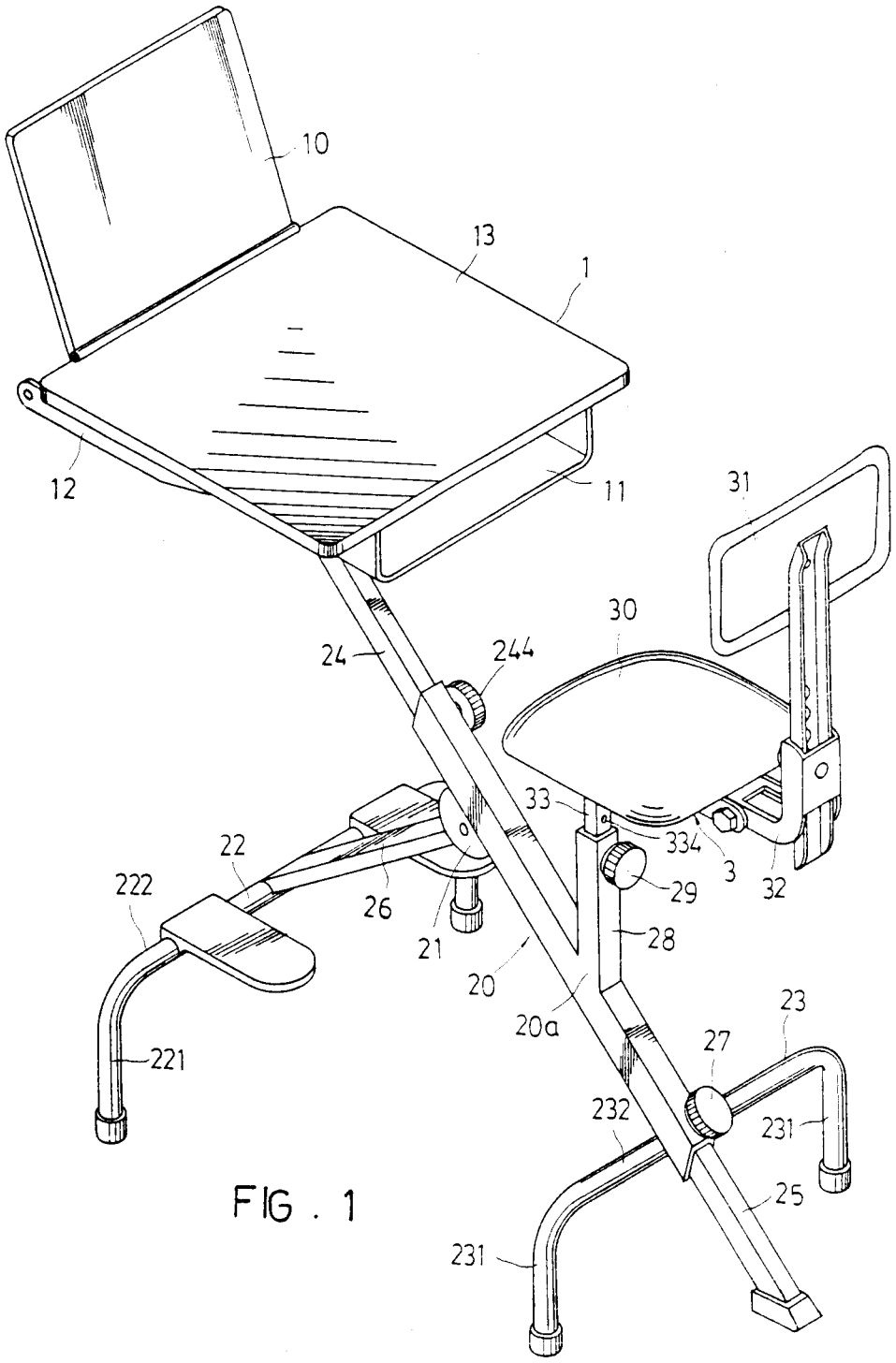
FIG. 1 is a perspective view of a combined table and chair assembly of the present invention.

Referring to FIG. 1, a collapsible combined table and chair assembly of the present invention is shown, having a frame which includes a telescopic strut 20, a front U-shaped support 22, a rear U-shaped support 23, and a front strut 26. The front U-support 22 has two legs 221 and a front transverse rod 222. Similarly, the rear U-support 23 has two legs 231 and a rear transverse rod 232.

Figure 2:
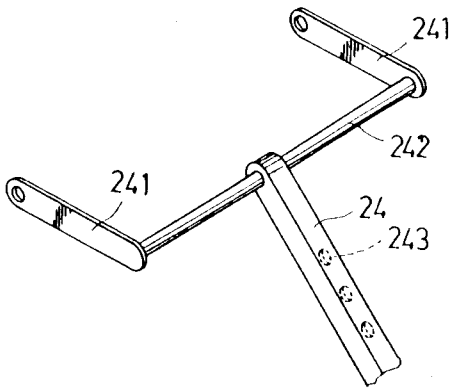
FIG. 2 shows a forked end portion of a telescopic strut of the assembly of FIG. 1.

The telescopic strut 20 includes an elongated tube **20*a* having its lower end fixed to the transverse rod 232 and its upper end hinged to the strut 26 so as to extend forwardly and upwardly when the assembly is not collapsed. As shown in FIG. 2, at the upper end of the tube 20*a* is an upper rod section 24 inserted slideably in the elongated tube 20*a* and having a forked end portion to extend horizontally when the assembly is not collapsed. The forked end portion is constituted of two parallel arms 241 and an arm connecting member 242 which is fixed to the upper rod section 24 at its intermediate portion. The upper rod section 24 is provided with holes 243 which can be aligned selectively with a hole (not shown) of the elongated tube 20*a* for inserting a locking pin (not shown) of a locking member 244, thereby enabling the upper rod section 24 to be locked adjustably against the elongated tube 20*a***.

At the intermediate portion of the elongated tube **20*a* is disposed an upstanding support tube 28 and a seat supporting member 33 inserted slideably in the upper portion of the support tube 28. The seat supporting member 33 is provided with holes 334** to be aligned selectively with a hole (not shown) of the support tube 28 for inserting a locking pin (not shown) of a locking member 29. At the lower end of the elongated tube 20*a* is inserted slideably a lower rod section 25 which extends downwardly and rearwardly when the assembly is stretched. A locking means 27 identical to the locking member 29 is provided to lock the lower rod section 25 againt the elongated tube 20*a*.

Figure 3:
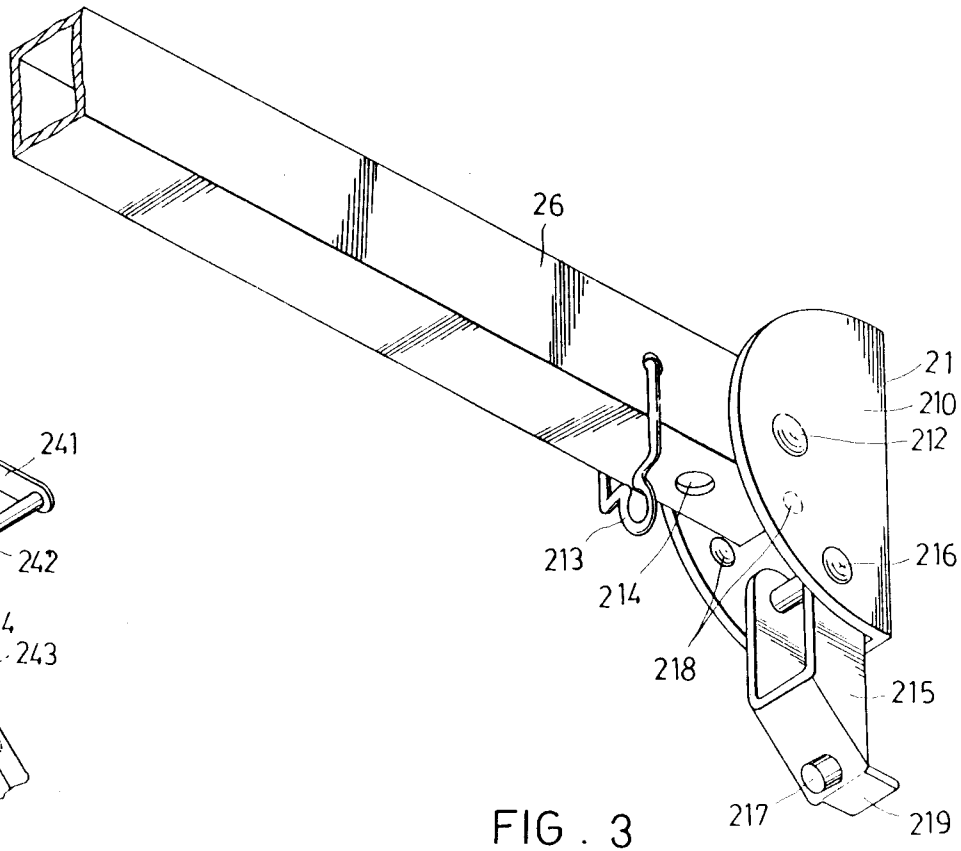
FIG. 3 shows a locking means of the assembly of FIG. 1.

The strut 26 has its lower end fixed to the front transverse rod 222 and an upper end hinged to the tube 20*a* at a location higher than that at which the upstanding support 28 is located. As shown in FIG. 3, to the tube 20*a* is welded a U-shaped plate bracket 21 which has two flanks 210 on which the strut 26 is mounted pivotally at 212. The strut 26 is provided with an engaging hole 214 and a loop member 213. The loop member 213 is formed by a substantially U-shaped curved rod which has two ends secured to the strut 26.

A locking member 215 is hinged to the flanks 210 through a pin 216 and has a hooking flange 219 at its end. An engaging projection 217 extends from a bevelled face of the locking member near the flange 219. When the strut 26 is moved away from the strut 20 and the locking member 215 is turned toward the strut 26 to engage the hooking flange 219 and the engaging protrusion respectively with the looped member 213 and the engaging hole 214, the strut 26 is locked against movement relative to the strut 20, thereby placing the assembly in a stretched position. It can be appreciated that, to engage the hooking flange 219 with the loop 213, a force must be applied to move the loop 213 to tie up the hooking flange 219. In order to prevent the strut 26 from moving freely when the assembly is collapsed, two bosses 218 are disposed respectively at the inner sides of the flanks 210 to contact frictionally with the strut 26 when the strut 26 moves toward the strut 20.

Figure 4:
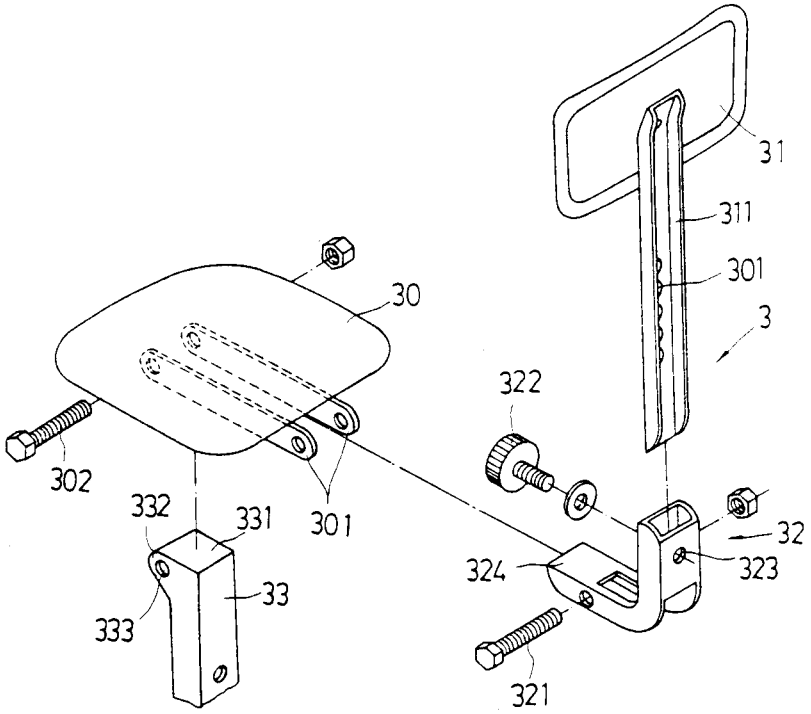
FIG. 4 is an exploded view of a chair unit of the assembly.

A chair unit 3 is mounted on the upstanding support 28 of the strut 20. As better shown in FIG. 4, the chair unit 3 includes a seat panel 30 which has two underlying brace bars 301 extending from the rear side to the front side of the panel 30. The seat supporting member 33 which is mounted on the upstanding support 28 has an enlarged top portion with a top bearing face 331 for supporting the seat panel 30. The enlarged top portion of the seat supporting member 33 is provided with a slanted front end face 332 and a hinge hole 333 near the front end face 332. The front ends of the brace bars 301 are hinged to the seat supporting member 33 through a pin 302 and the hole 333, thereby enabling the seat panel to turn about the pin 302. Since the front end face 332 extends forwardly and downwardly from the top bearing face 331 to restrict the movement of the seat panel 30, the seat panel 30 can be turned only to a nonused vertical position from a used horizontal position when the assembly is collapsed.

There is a back 31 mounted on a back supporting member 311 which in turn is connected to an angled connecting member 32. The angled connecting member 32 includes a horizontal portion hinged to the rear ends of the brace bars 301 through a pin 321, and a vertical tube portion into which the back supporting member 311 is inserted slideably. By means of the angled connecting member 32, the back 31 can be folded back to the seat panel 30 and can stand upward by turning about the pin 321. The front end 324 of the horizontal portion of the connecting member 32 extends below and engages with the bottom side of the seat 30 when the back supporting member 311 moves upward so that the back 31 will never turn backwards. The back supporting member 311 is provided with holes 310 to be aligned selectively with a hole 323 of the vertical tube portion of the connecting member 32. A locking member 322 identical to the locking member 29 is provided to secure releaseably the back supporting member 311 to the connecting member 32 so as to adjust the height of the back relative to the seat panel 30.

Figure 5:
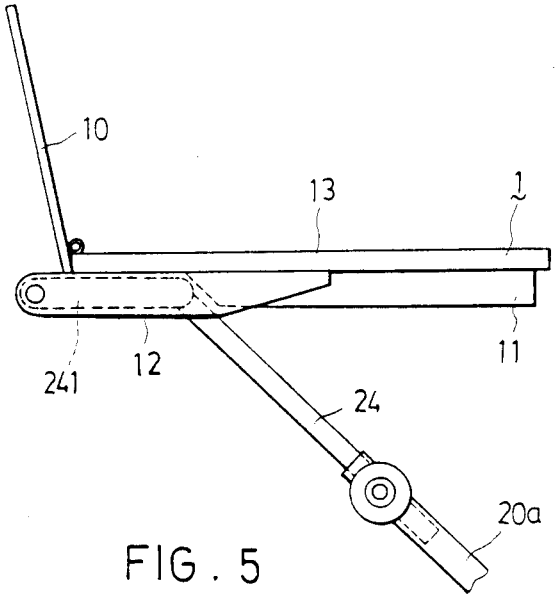
FIG. 5 shows a table unit in a non-collapsed position.
Figure 6:
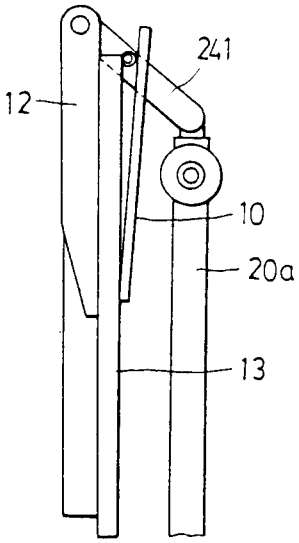
FIG. 6 shows the table unit in a collapsed position.

Referring to FIGS. 5 and 6 in combination with FIGS. 1 and 2, a table unit 1 is mounted on the parallel arms 241 of the upper rod section 24 of the telescopic strut 20. The table unit 1 includes a table panel 13 to be laid on the parallel arms 241 when the assembly is not collapsed. The table panel 13 has two brace bars 12 attached to the bottom side of the table panel 13 and extending from the rear side to the front side thereof. The front ends of the brace bars 12 are hinged to the ends of the arms 241 so as to permit the table panel 13 to turn forwardly and then downwardly when the assembly is collapsed. A case 11 is provided to the underside of the table panel 13 for holding books and the like. At the front side of the table panel 13 is a vertical reading support plate 10 hinged to the table panel so as to be foldable relative to the table panel 13.

Figure 7:
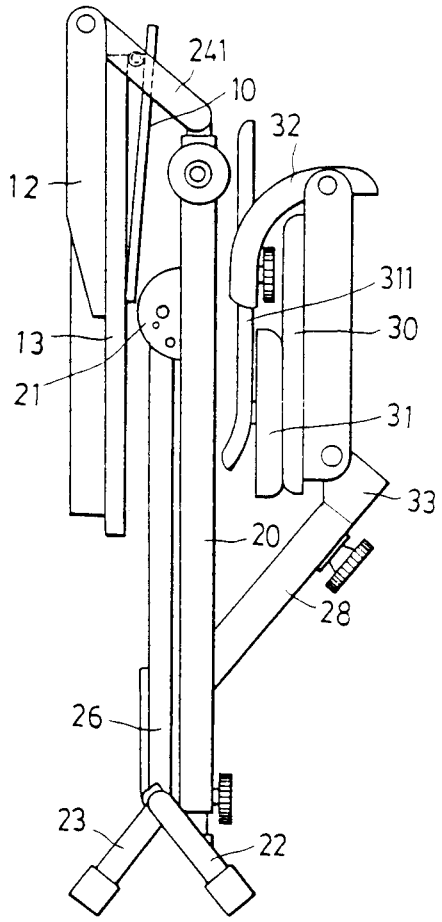
FIG. 7 shows a collapsed position of the assembly.

FIG. 7 shows a folded position of the assembly in which the struts 20 and 26 are close to one another and stand upright by means of their legs 22 and 23. The table panel 13 is folded downwardly at the front side of the struts and the chair panel 30 is turned upward and the back 31 and the back supporting member 311 are folded back to the chair panel 30.

With the invention thus explained, it is apparent that various modifications and variations can be made without departing from the scope of the invention. It is therefore intended that the invention be limited as indicated in the appended claims.

What I claim is:

1. A collapsible combined table and chair assembly comprising:

a front U-shaped support having a front transverse rod and two front legs;

a rear U-shaped support having a rear transverse rod and two rear legs;

a telescopic strut having a lower end portion connected fixedly to said rear transverse rod and extending upwardly and forwardly to an upper end portion thereof, said telescopic strut further having an upstanding support extending from said telescopic strut between said upper and lower end portions;

a first strut having a lower end fixed to said front transverse rod, and an upper end hinged to said telescopic strut;

a plate bracket of substantially U-shaped cross-section which has a base plate portion secured to said telescopic strut at a location higher than that at which said upstanding support is located and including two parallel flanks at opposite sides of the base plate to confine a space for receiving and to serve as supports for hinging said first strut at a first pivot axis;

a locking means for preventing said upper end of said first strut from pivoting relative to said telescopic strut;

a table unit connected hingedly to said upper end portion of said telescopic strut; and a chair unit connected hingedly to said upstanding support.

2. A collapsible combined table and chair assembly as claimed in claim 1, wherein said telescopic strut comprises an elongated tube having a lower end portion fixed to said rear transverse rod and extending from said rear transverse rod upwardly and forwardly when the assembly is not collapsed, an upper section connected telescopically to an upper end portion of said elongated tube, said upper section having a forked end portion for extending forwardly and horizontally to support said table unit, means for adjustably positioning said upper section with respect to said elongated tube, a lower section connected telescopically to said lower end portion of said elongated tube, and means for adjustably positioning said lower section with respect to said lower end portion of said elongated tube.

3. A collapsible combined table and chair assembly as claimed in claim 2, wherein said table unit has a table panel adapted to be laid on said forked end portion and having a front side and a rear side, and brace bars underlying and attached to the bottom side of said table panel and extending from said rear side to said front side of said table panel, said brace bars having front ends hinged to the ends of said forked end portion so as to permit said table panel to turn forwardly and then downwardly when the assembly is collapsed.

4. A collapsible combined table and chair assembly as claimed in claim 3, wherein said forked end portion includes two parallel arms having front ends hinged respectively to said front ends of said brace bars, and an arm connecting rod interconnecting rear ends of said arms and fixed to said upper section at an intermediate portion of said arm connecting rod.

5. A collapsible combined table and chair assembly as claimed in claim 3, wherein said table panel further has a vertical reading support plate hinged to said front side of said table panel.

6. A collapsible combined table and chair assembly as claimed in claim 1, in which said upstanding support includes a support tube extending from said first strut, a seat supporting member mounted telescopically on said support tube and having an enlarged top portion which has a top bearing face, wherein said chair unit includes a chair panel to be laid on said top bearing face, brace bars underlying and attached to the bottom side of said chair panel, said brace bars having front ends hinged to a front end portion of said enlarged top portion.

7. A collapsible combined table and chair assembly as claimed in claim 6, wherein said chair unit further has a back, and means for connecting said back to said chair panel in a folding relationship.

8. A collapsible combined table and chair assembly as claimed in claim 7, wherein said means for connecting said back includes an angled connecting member which has a horizontal portion hinged to rear ends of said brace bars of said chair panel and a vertical portion extending from said horizontal portion, a back supporting member having an upper end connected to said back and a lower end connected telescopically to said vertical portion, and means for adjustably positioning said back supporting member to said vertical portion.

9. A collapsible combined table and chair assembly as claimed in claim 8, wherein said front end portion of said enlarged top portion of said seat supporting member has an inclined front face which extends downwardly and forwardly from said top bearing face.

10. A collapsible combined table and chair assembly as claimed in claim 1, wherein said locking means includes a hook member which has one end hinged to said flanks to pivot about a second pivot axis that is lower than said first pivot axis, an opposite end with a hooking flange and an engaging protrusion, and a loop member attached to said second strut for engaging with said hooking flange when said hook member turns toward said second strut, said second strut further having an engaging hole therein to engage with said engaging protrusion.

11. A collapsible combined table and chair assembly as claimed in claim 1, wherein said upstanding support has an enlarged top portion defining a top bearing face and an inclined face which extends forwardly and downwardly from said top bearing face, said chair unit including a chair panel to be laid on said top bearing face, two brace bars underlying an attached to the bottom side of said chair panel, said brace bars having front ends hinged to said enlarged top portion at a location adjacent to said inclined face for turning about the horizontal axis.

12. A collapsible combined table and chair assembly as claimed in claim 11, wherein said upstanding support includes a support tube extending from said first strut and a seat supporting member mounted telescopically on said support tube, said seat supporting member having an enlarged top portion.

13. A collapsible combined table and chair assembly as claimed in claim 12, wherein said chair unit further has a back, and means for connecting said back to said chair panel, said means including an angled connecting member, which has a horizontal portion hinged to rear ends of said brace bars of said chair panel and a vertical portion extending from said horizontal portion, a back supporting member having an upper end connected to said back and a lower end connected telescopically to said vertical portion, and means for adjustably positioning said back supporting member to said vertical portion.

14. A collapsible combined table and chair assembly as claimed in claim 1, wherein said telescopic strut includes an elongated tube connected to said rear transverse rod, an upper section connected telescopically to said elongated tube and connected to said table unit, and a lower section connected telescopically to said elongated tube and extending downwardly to bear against a support surface.

* * * * *